United States Patent [19]

Kumagai

[11] Patent Number: 4,589,930

[45] Date of Patent: May 20, 1986

[54] CASTING METAL MOLD AND METHOD OF PRODUCING THE SAME

[75] Inventor: Yózó Kumagai, Katsuta, Japan

[73] Assignee: Hitachi, Ltd., Tokyo, Japan

[21] Appl. No.: 584,821

[22] Filed: Feb. 29, 1984

[30] Foreign Application Priority Data

Mar. 2, 1983 [JP] Japan ..... 58-32786

[51] Int. Cl.[4] ..... C22C 9/00

[52] U.S. Cl. ..... 148/11.5 C; 164/418; 420/492; 148/12.7 C; 148/160; 148/411

[58] Field of Search ..... 420/492; 148/11.5 C, 148/12.7 C, 160, 411

[56] References Cited

U.S. PATENT DOCUMENTS 3,170,204 2/1965 Tarmann ..... 148/160
4,421,570 12/1983 Gravemann ..... 148/12.7 C

FOREIGN PATENT DOCUMENTS 9117 1/1979 Japan ..... 420/492
131337 8/1982 Japan ..... 420/492

*Primary Examiner*—Veronica O'Keefe
*Attorney, Agent, or Firm*—Antonelli, Terry & Wands

[57] ABSTRACT

A casting metal mold made of a copper alloy consisting essentially of 0.01 to 3 wt % of zirconium, 0.03 to 5 wt % of titanium and, as required, 0.03 to 2 wt % of chromium and the balance substantially copper, the copper alloy having a structure in which precipitate phase consisting of compound of copper and at least one of zirconium, titanium and chromium exists, and having a Brinell hardness between $H_B$ 100 to $H_B$ 500 and an electric conductivity between 20 and 80% in terms of IACS. This metal mold suffers only small deformation during casting and, hence, less liable to cause run-out of the melt. The casting obtained by this metal mold, therefore, has no or only slight fins.

10 Claims, 2 Drawing Figures

CASTING METAL MOLD AND METHOD OF PRODUCING THE SAME

BACKGROUND OF THE INVENTION

1. Field of the Invention

The present invention relates to a metal mold for use in the casting of articles from metals or plastics, as well as to a method of producing such a metal mold.

The metal mold of the invention is suitable for use in such a casting method that melt of metal or plastic is cast into and solidified in a mold cavity conforming with the contour of the article to be obtained, the cavity being formed between two mold parts mechanically assembled together.

The metal mold of the invention is suited particularly to casting of articles from, for example, cast iron, copper alloys, aluminum alloys and so forth, particularly from cast iron.

2. Description of the Prior Art

It is well known to use a metal mold made of a copper alloy, in the production of article by casting a melt of metal.

For instance, Japanese patent application Laid-Open Publication No. 91839/82 discloses a casting metal mold made of a copper alloy consisting essentially of at least one of chromium, zirconium and cadmium and the balance substantially cooper. It is stated therein that this metal mold made of the copper alloy can prevent a large temperature gradient from occurring because the temperature difference between the melt-contacting side and the opposite side of the mold wall becomes large owing to a high heat conductivity of this metal mold.

On the other hand, Japanese patent Publication No. 45816/82 discloses a mold material for use in the continuous casting of steel, the material consisting essentially of chromium, zirconium and the balance substantially copper. This literature shows also a mold material of a copper-chromium alloy and a mold material of a copper-zirconium alloy which, according to this literature, are inferior to the mold material of copper-chromium-zirconium alloy in the aspect of useful life of the mold.

SUMMARY OF THE INVENTION

1. Object of the Invention

An object of the invention is to provide a metal mold which is less liable to be deformed and has longer life than the aforesaid metal mold made of copper alloy, as well as a method of producing such a metal mold.

2. Brief Summary of the Invention

The metal mold of the invention is made of a copper alloy containing zirconium and titanium, or a copper alloy containing zirconium, titanium and chromium.

The metal of the metal mold of the invention finally has a structure in which there exists a precipitate phase consisting of a compound of copper and at least one of zirconium, titanium and chromium, and a Brinell hardness $H_B$ of not smaller than 100, as well as an electric conductivity of not smaller than 20% (IACS).

In the material of the metal mold of the invention, the balance component other than zirconium and titanium or other than zirconium, titanium and chromium is preferably copper, although in the invention other components may be contained in their content range wherein they do not impair the final properties of the metal mold such as the hardness and the electric conductivity.

The metal mold of the invention can be used in continuous casting and also in batch-type casting in which a melt is cast into and solidified in the metal mold to become a casting.

Principal function of the mold in the continuous casting process is to solidify the portion of the melt contacting the mold inner surface, during passage of the melt through the mold. From this point of view, it is the most important requisite for the mold to have a high heat conductivity. Other requisites such as mechanical properties, workability and so forth come only after the satisfaction of the first requisite, i.e. the high heat conductivity.

In contrast to the above, in the case of a batch-type casting process in which the melt is held in the metal mold until it is solidified, the high heat conductivity is not the most important requisite. Namely, a too high heat conductivity impairs the run of the melt to all parts of the mold cavity and increases the tendency of cracking of the castings when they are taken out of the mold. Usually, the metal mold of the kind described has two or more mold parts assembled and fixed together by means of bolts or pins to form therein the mold cavity conforming with the contour of the cast product to be obtained. In the metal mold for batch-type casting process, therefore, it is more significant to avoid the formation of gas between the juncture surfaces of the mold parts when they are brought together or during casting due to a thermal deformation of the mold parts. Any gap existing between the juncture surfaces of the mold parts undesirably permits the melt to leak therethrough to leave run-outs or fins on the castings undesirably. The castings having run-outs and fins have to be subjected to a post-processing to get rid of such run-outs and fins.

In the metal mold of the invention, the formation of the gap at the time of assembling of the mold parts or during casting due to thermal deformation is avoided to eliminate any leak of the melt through the juncture surfaces of the mold parts. Consequently, the post-processing for removing the run-outs and fins after casting is completely dispended with or the number of steps of such post-processing is reduced advantageously.

In addition, the metal mold of the invention ensures sufficient run of the melt to every part of the mold cavity, as well as small wear and excellent durability, because the electric conductivity and the hardness are maintained at adequate levels. The electric conductivity of the metal mold can be increased by completely eliminating or decreasing the contents of the alloying components to make the material approach the pure copper. On the other hand, for enhancing the mechanical strength and the hardness, the addition of alloying components such as zirconium, titanium and chromium is essential. In the metal mold in accordance with the invention, the contents of zirconium, titanium and chromium are controlled suitably to maintain simultaneously both of an electric conductivity of not smaller than 20% (IACS) and a Brinell hardness of not smaller than $H_B$ 100 in order to ensure sufficient run of the melt, the electric conductivity of the metal mold is preferably selected to be less than 80% (IACS).

Any value of electric conductivity of the metal mold below 20% (IACS) undesirably coarsens the structure of casting due to a too small cooling rate of the melt. In addition, it takes a long time until the casting is taken out of the metal mold after casting, resulting in a reduced production speed of the castings. In addition, the number of casting operation cycles till cracking in the metal mold surface is decreased undesirably.

An insufficient hardness of the metal mold causes a rapid wear of the juncture surfaces of the mold parts to form a gap therebetween. Consequently, the melt is allowed to leak through the gap to form run-outs or fins on the casting. In order to obviate this problem, it is necessary to maintain a Brinell hardness of not smaller than $H_B$ 100 thereby to enhance the durability through minimizing the wear of the metal mold. A too high hardness of the metal mold material undesirably impairs the workability such as forgeability and machinability to make the fabrication of the metal mold difficult. From this point of view, the hardness of the metal mold material is preferably selected not to exceed H500.

The metal mold of the invention has a structure in which there is a dispersed precipitate phase consisting of compound of copper and at least one of zirconium and titanium or compound of copper and at least one of zirconium, titanium and chromium. The metal mold of the invention made of copper-zirconium-titanium alloy or copper-zirconium-titanium-chromium alloy containing the above-mentioned precipitate phase exhibits extremely small deformation when assembling the mold parts or during casting the melt.

In order to realize the structure having the above-mentioned precipitate phase, the metal mold should be subjected to a solid solution treatment and an aging treatment in the course of the production thereof.

Preferably, the metal mold of the invention is made from a material having a composition consisting essentially of 0.01 to 3 wt % of zirconiuum, 0.03 to 5 wt % of titanium and the balance substantially copper, or a composition consisting essentially of 0.01 to 3 wt % of zirconium, 0.03 to 5 wt % of titanium, 0.03 to 2 wt % of chromium and the balance substantially copper.

When the copper-zirconium-titanium alloy is used as the material, the metal mold is preferably cold-worked after the solid solution treatment and before the aging treatment, in order to obtain a Brinell hardness exceeding $H_B$ 100. The metal mold made of the copper-zirconium-titanium-chromium alloy can have a Brinell hardness of not smaller than $H_B$ 100 only with the solid solution treatment and the aging treatment. Needless to say, however, it is preferred also in this case to conduct a cold working before the aging treatment. In either case, the working ratio is preferably selected to a range between 10 and 20%. The cold working is preferably conducted by forging.

The metal mold of the invention can be produced by subjecting an as-cast material to a solid solution treatment and, after a cold working as desired, to an aging treatment. Preferably, the solid solution treatment is effected by water quenching after heating the material up to temperature of 950° C. ±20° C. and 1020° C. ±20° C., respectively, when the material is of copper-zirconium-titanium alloy and copper-zirconium-titanium-chromium alloy. On the other hand, the aging treatment is conducted at a temperature of about 500° C., preferably at a temperature ranging between 450° and 480° C. The cold working prior to the aging treatment may be conducted at the room temperature.

A hot working may be conducted as a step preceeding to the solid solution treatment. By conducting the hot working in advance to the solid solution treatment, it is possible to further increase the mechanical strength and the hardness of the metal mold.

In the metal mold of the invention, the reasons for delimiting the ranges of contents of zirconium, titanium and chromium as mentioned before are as follows.

0.01 to 3 wt % of zirconium:

The solid solubility of zirconium to copper is about 0.01 to 0.02 wt % at 450° C. In order to precipitate the compound of zirconium and copper through an aging treatment, it is necessary that zirconium is contained in copper by an amount in excess of the solid solubility at the aging temperature. Therefore, the zirconium content is preferably not smaller than 0.01 wt %. On the other hand, a zirconium content exceeding 3 wt % causes a drastic reduction in the electric conductivity, as well as substantial saturation of the increase in the hardness and tensile strength. Such a large zirconium content is not preferred also in that it seriously impairs the cold workability. The zirconium content range between 0.03 and 0.5 wt % is especially preferable.

0.03 to 5 wt % of titanium:

Titanium is an element which is essential in enhancing the mechanical strength and the hardness. In order to obtain such effects, the titanium content should be not smaller than 0.03 wt %. However, when the titanium content exceeds 5 wt %, embritlement of the material is caused during the cold working or the hot working to make it difficult to obtain the mold cavity precisely in conformity with the contour of cast product. In addition, a large titanium content causes a drastic reduction in the electric conductivity to a level below 20% (IASC). For these reasons, the titanium content should be selected to fall between 0.03 and 5 wt %, preferably between 0.05 and 2 wt %.

0.03 to 2 wt % of chromium:

The solid solubility of chromium to copper at 450° C. ranges between 0.03 and 0.04 wt %. From this point of view, the chromium content should be at least not smaller than 0.03 wt %. The tensile strength and the hardness at high temperature increases as the chromium content is increased up to 2 wt %. However, an increase in the chromium content beyond 2 wt % causes a substantial saturation in the increment of the tensile strength and the hardness but, on the other hand, causes a drastic reduction in the electric conductivity. The chromium content range between 0.5 and 1.5 wt % is especially preferable.

The material mold of the invention can be used for both the continuous casting process and the batch-type casting process in which the melt is held in the metal mold until it is solidified. In either case, the metal mold is preferably of water-cooled type. Namely, the metal mold of the invention is preferably provided therein with a cooling water passage through which cooling water is circulated to cool the metal mold, thereby to further diminish the expansion and deformation of the metal mold during casting. The internal water cooling of the metal mold is effective also in preventing the metal mold from cracking due to thermal stress produced by the repeated casting operations.

The metal mold of the invention, when it is used in the continuous casting process, does not necessarily require to be provided with a coating on its surface contacting the melt. However, when the metal mold is used in the batch-type casting process in which the melt is held in the metal mold having a mold cavity conforming with the contour of cast product until it is solidified, the metal mold is preferably coated at least on the surface thereof contacting the melt. The coating on the metal mold surface contacting the melt offers the following advantages:

(a) an easy parting of the casting from the metal mold, (b) prevention of melting of metal mold surface due to deposition of melt, and (c) easy degassing from the melt.

In the invention, it is possible to use any one of coating agents which are commercially available. For instance, commercially available coating agents of silicon system can be used quite effectively. When the coating is applied, the metal mold surface is preferably roughened by brushing or shot blasting. The metal mold of the invention does not suffer from damage such as dropping of a part of brim of the mold cavity when the same is subjected to a mechanical roughening process, and ensures a good adhesion of the coating. The coating is preferably applied by spraying. A coating layer thickness of not greater than 1 mm will be enough. Since the coating layer is generally porous, the gas in the melt is allowed to escape through pores in the coating layer.

The conventional metal molds made of pure copper, copper-chromium alloy and copper-chromium-zirconium alloy are inferior to the metal mold of the invention due to the following reasons.

(1) Pure copper and copper alloys mentioned above cause, due to too high heat conductivity, too rapid cooling of the melt resulting in an imperfect run of the melt to all parts of the mold cavity.

(2) The metal mold of pure copper and the metal mold of copper-zirconium alloy are generally large in thermal expansion coefficient and small in mechanical strength, so that the metal mold tends to be deformed during casting. Consequently, the run-outs of the melt and the fins are liable to be formed on the casting.

(3) The metal mold of copper-zirconium-chromium alloy also has a greater tendency of deformation than the metal mold of the invention.

DESCRIPTION OF THE PREFERRED EMBODIMENT

Figure 1:
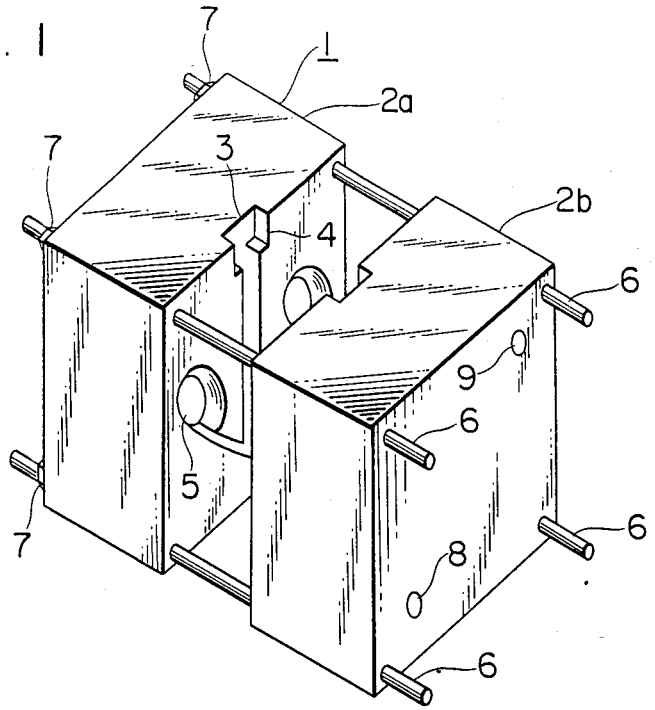
FIG. 1 is a perspective view of a metal mold in accordance with an embodiment of the invention.

As will be seen from FIG. 1, a metal mold 1 embodying the invention has a couple of mold parts 2*a* and 2*b* which are adapted to form, when assembled together, the metal mold 1 having a sprue 3, runner 4 and a mold cavity 5 conforming with the contour of the cast article to be obtained, i.e. the casting. Although not shown, a feeder head or riser portion is preferably connected to the mold cavity 5. The mold parts 2*a* and 2*b* are connected to each other to form an integral body by means of bolts 6 and nuts 7. Before casting, a coating agent is applied to the inner surfaces of the mold cavity 5, the runner 4 and the sprue 3. A reference numeral 8 denotes a cooling water supply port, while a numeral 9 designates a port for discharging the water.

EXAMPLES

Example 1

As-cast material consisting essentially of 0.1 wt % of zirconium, 0.03 wt % of titanium and the balance substantially copper was subjected to a solid solution treatment and then, after a cold forging, to an aging treatment conducted for 4 hours at 480° C. The solid solution treatment was conducted by heating the material to and holding it at 950° C. for 1.5 hours and then water-quenching the same. The cold forging was conducted at a working ratio of 15%.

The tensile strength, Brinell hardness and the electric conductivity of this material at normal temperature were measured to be 34.8 Kg/mm$^2$, $H_B$ 104 and 77% (IACS), respectively.

Mold parts 2*a*, 2*b*, each having cylindrical cavity 5 as shown in FIG. 1, were machined out of the aforesaid material. The inner surfaces of the mold parts 2*a*, 2*b* contacting the melt were roughened by brushing and were coated with a commercially available coating agent of silicon system by spraying to a thickness of about 0.1 mm. Two mold parts were coupled together by means of bolt and nuts to form the metal mold 1. Then, a melt of cast iron was cast into the mold cavity at a temperature between 1340° and 1390° C. The metal mold was constructed as an internally water-cooled mold. The melt of cast iron had a composition consisting essentially of 3.7 wt % of carbon, 1.9 wt % of silicon, 0.6 wt % of manganese, 0.3 wt % of phosphorus, 0.02 wt % of sulfur and the balance substantially iron. After the solidification of the melt, the casting was taken out by separating the mold parts 2*a* and 2*b* from each other after loosening the nuts. The parting of the casting from the mold parts was made in quite a good manner and excellent run of the melt was confirmed.

The metal mold did not shown any deformation and no run-out from the juncture surfaces of the mold parts 2*a* and 2*b* nor fins were observed even after 3000 cycles of casting operation.

Example 2

An as-cast material consisting essentially of 0.18 wt % of zirconium, 0.26 wt % of titanium and the balance substantially copper was hot-forged at a temperature between 760° and 870° C. and was subjected to a solid solution treatment. The material was then cold-forged followed by an aging treatment. The solid solution treatment, cold forging and the aging treatment were conducted under the same conditions as Example 1. The hot forging was conducted at a working ratio of 30%. The material thus obtained showed a tensile strength, Brinell hardness and an electric conductivity of 34.0 Kg/mm$^2$, $H_B$ 114 and 30% (IACS), respectively, at the normal temperature.

A metal mold of the same shape as that in Example 1 was produced from this material, and was subjected to 1000 cycles of casting of the melt of cast iron. No run-out nor fins, not to mention cracking of the metal mold due to thermal stress, was observed.

Example 3

A material sample No. 1 was prepared from an alloy consisting essentially of 0.05 wt % of zirconium, 0.12 wt % of titanium, 0.74 wt % of chromium and the balance substantially copper, by subjecting this alloy to a solid solution treatment and then to an aging treatment. A material sample No. 2 was prepared from the same alloy as sample No. 1 by a process having the step of a cold forging between the solid solution treatment and the aging treatment. A material sample No. 3 was prepared from the same alloy as sample Nos. 1 and 2. In this case, the material was subjected to a hot forging in advance to the solid solution treatment and to a cold forging before the aging treatment, i.e. after the solid solution treatment. In each case, the solid solution treatment was conducted by heating the alloy at 1020° C. for 1.5 hours and then water-quenching the same. On the other hand, the aging treatment was conducted by holding the alloy at 450° C. for 4 hours followed by air-cooling. The cold forging was conducted at normal temperature with a working ratio of 15%, while the hot forging was conducted at 760° to 870° C. with a working ratio of 30%.

The tests were conducted for the sample Nos. 1 to 3 to measure the tensile strength, hardness and electric conductivity at normal temperature, the results of which are shown in Table 1 below.

TABLE 1

| Sample No. | Tensile Strength ($Kg/mm^2$) | Brinell Hardness ($H_B$) | Electric Conductivity (% IACS) |
|---|---|---|---|
| 1 | 42.5 | 127 | 58 |
| 2 | 45.4 | 130 | 58 |
| 3 | 50.0 | 151 | 59 |

Metal mold having cavities as shown in FIG. 1 were produced from these samples and were put into casting of the melt of cast iron in the same way as Example 1. No deformation of the metal mold was caused and no run-out nor fins were obtained after 1000 cycles of casting operation.

Example 4

An as-cast material consisting essentially of 0.3 wt % of zirconium, 1.0 wt % of titanium and 0.55 wt % of chromium and the balance substantially copper was prepared. The as-cast material was subjected to a solid solution treatment consisting of holding the material at 1020° C. for 1.5 hours followed by water-quenching, and further to an aging treatment consisting of heating at 450° C. for 4 hours followed by air-cooling.

Figure 2:
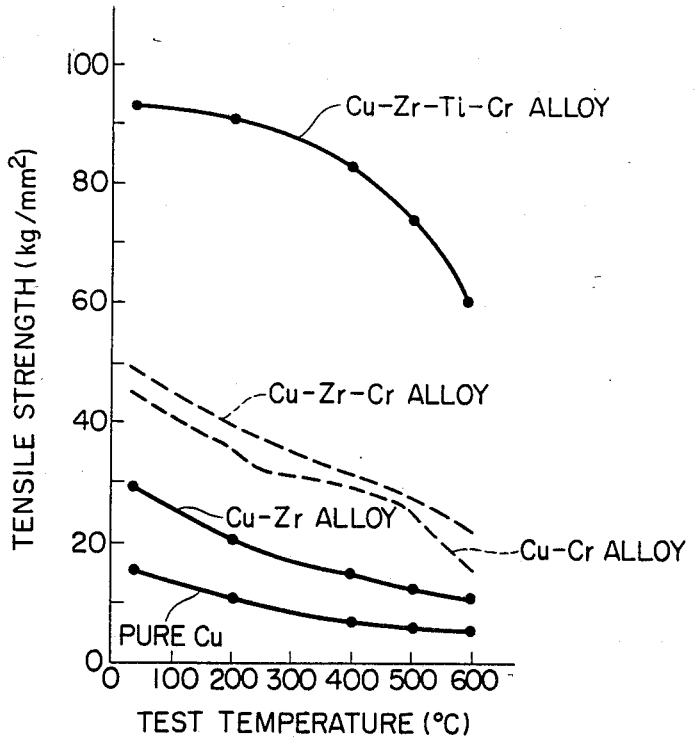
FIG. 2 is a graph showing the relationship between the tensile strength and the test temperature of pure copper and various copper alloys.

The sample thus obtained were subjected to a tensile test to examine the tensile strength at various temperatures between the normal temperature and 600° C., the result of which is shown in FIG. 2. The surface region of the metal mold contacting the melt is heated up to a considerably high temperature even though the metal mold is water-cooled. In the casting of the melt of cast iron, the temperature is increased to a level as high as about 500° C. at the maximum. In order to avoid any deformation of the metal mold during casting, it is necessary that the metal mold has a high strength also at high temperature. As will be clearly seen from FIG. 2, the copper alloy in this Example shows a remarkable tensile strength at high temperature in comparison with the copper alloys in other Examples. This means that the copper alloy in this Example has a large resistance to deformation at a high temperature.

COMPARISON EXAMPLES

Tensile strength and hardness at normal temperature were measured for pure copper and an alloy consisting essentially of 0.3 wt % of zirconium and the balance substantially copper. Electric conductivity was also measured for the alloy containing zirconium. The results of the measurements are shown in Table 2 below. The pure copper was in the as-cast state, while the alloy containing zirconium was subjected to a solid solution treatment consisting of heating at 950° C. for 1.5 hours followed by water-quenching and, after a cold working with working ratio of 15% at normal temperature, further to an aging treatment consisting of heating at 450° C. for 4 hours followed by air-cooling.

TABLE 2

| Sample | Tensile Strength ($Kg/mm^2$) | Brinell Hardness ($H_B$) | Electric Conductivity (% IACS) |
|---|---|---|---|
| pure Cu | 15.0 | 47 | — |
| Cu—0.3% Zr alloy | 23.0 | 68.8 | 88.5 |

The pure copper and the alloy containing 0.3 wt % of zirconium showed tensile strengths as shown in FIG. 2 at various temperatures between the normal temperature and 600° C.

FIG. 2 shows also the characteristics of an alloy consisting essentially of 0.16 wt % of zirconium, 0.71 wt % of chromium and the balance substantially copper and an alloy consisting essentially of 0.69 wt % of chromium and the balance substantially copper, extracted from FIG. 2 in Japanese Patent Publication No. 45816/82.

Clearly, the pure copper and these copper alloys have much smaller tensile strengths at high temperature than the copper alloy in Example 3 of the invention, i.e. the copper alloy containing zirconium, titanium and chromium.

A metal mold was fabricated from the alloy consisting essentially of 0.3 wt % of zirconium and the balance substantially copper, in the same way as Example 1, and was subjected to a casting operation. In this case, cracking was observed in the surface defining the mold cavity conforming with the contour of the cast product, after 500 cycles of casting operation. In addition, as the number of repetition cycles of casting approaches 1000, the formation of fins due to deformation of the metal mold became appreciable. After 1000 cycles of casting operation, fins of maximum thickness of 0.3 mm were formed on the surface of the casting. In addition, a failure of the sprue due to melting was observed after the 1000 cycles of casting operation.

EFFECT OF THE INVENTION

As will be understood from the foregoing description, the metal mold in accordance with the invention suffers much smaller deformation during casting than the conventional metal molds made of pure copper or copper alloys. With the metal mold of the invention, therefore, it is possible to remarkably diminish the run-out of the melt, as well as fins on the final cast products.

What is claimed is:

1. A batch-type casting metal mold made of a copper alloy consisting essentially of 0.01 to 3 wt % of zirconium, 0.03 to 5 wt % of titanium and the balance substantially copper, said alloy having a structure in which a precipitate phase consisting of a compound of copper and at least one of zirconium and titanium exists, said metal mold having, at the normal temperature a Brinell hardness between $H_B$ 100 and $H_B$ 500 and an electric conductivity between 20 and 80% in terms of IACS.

2. A casting metal mold according to claim 1, wherein said metal mold has at least two mold parts which, when mechanically assembled together, define therein a mold cavity conforming wiht the contour of the article to be formed by casting.

3. A casting metal mold according to claim 2, wherein the inner surface of said mold cavity is coated with a coating layer.

4. A casting metal mold according to claim 1, wherein said metal mold has an internal water-cooling structure.

5. A batch-type casting metal mold made of a copper alloy consisting essentially of 0.01 to 3 wt % of zirconium, 0.03 to 5 wt % of titanium, 0.03 to 2 wt % of chromium and the balance substantially copper, said alloy having a structure in which a precipitate phase consisting of a compound of copper and at least one of zirconium, titanium and chromium exists, said metal mold having, at the normal temperature, a Brinell hardness between $H_B$ 100 and $H_B$ 500 and an electric conductivity between 20 and 80% in terms of IACS.

6. A casting metal mold according to claim 5, wherein said metal mold has at least two mold parts which, when mechanically assembled together, define therein a mold cavity conforming with the contour of the article to be formed by casting.

7. A casting metal mold according to claim 6, wherein the inner surface of said mold cavity is coated with a coating layer.

8. A casting metal mold according to claim 5, wherein said metal mold has an internal water-cooling structure.

9. A method of producing a batch-type casting metal mold made of a copper alloy consisting essentially of 0.01 to 3wt % of zirconium, 0.03 to 5 wt % of titanium, up to 2 wt % of chromium, and the balance substantially copper, said alloy having a structure in which a precipitate phase consisting of a compound of copper and at least one of zirconium, titanium and chromium exists, said metal mold having, at the normal temperature, a Brinell hardness between $H_B$ 100 and $H_B$ 500 and an electric conductivity between 20 and 80% in terms of IACS, said method comprising the steps of: subjecting an ingot of said copper alloy to a solid solution treatment; effecting a cold working after said solid solution treatment; and subjecting the cold-worked ingot to an aging treatment so as to precipitate said compound of copper and at least one or zirconium, titanium and chromium.

10. A method of producing a casting metal mold according to claim 9, characterized by further comprising a step of effecting a hot working on said ingot in advance to said solid solution treatment step.

* * * * *